United States Patent [19]

Bennett et al.

[11] 4,286,888

[45] Sep. 1, 1981

[54] BI-DIRECTIONAL BELT DRIVE, PRINT HEAD MOUNTING MEANS AND PRINTING PLANE ADJUSTMENT MEANS FOR SERIAL PRINTERS

[75] Inventors: Lewis W. Bennett, Nashua; Frederik T. Van Namen, Londonderry, both of N.H.

[73] Assignee: Centronics Data Computer Corp., Hudson, N.H.

[21] Appl. No.: 974,067

[22] Filed: Dec. 28, 1978

[51] Int. Cl.[3] ..... B41J 19/00

[52] U.S. Cl. ..... 400/320; 400/55; 400/57; 400/124; 400/323; 400/229; 400/236

[58] Field of Search ..... 400/55, 56, 57, 58, 400/59, 60, 124, 320, 322, 323, 328, 229, 236; 74/37; 346/139 B

[56] References Cited

U.S. PATENT DOCUMENTS

| | | | |
|---|---|---|---|
| 1,469,470 | 10/1923 | Wright | 74/37 X |
| 1,774,356 | 8/1930 | Cloud | 74/37 |
| 2,490,035 | 12/1949 | Deakin | 74/37 |
| 2,847,859 | 8/1958 | Lynott | 74/37 |
| 3,303,513 | 2/1967 | Woods et al. | 74/37 X |
| 3,795,766 | 3/1974 | Farlow | 346/139 B X |
| 3,935,936 | 2/1976 | Wilczewski | 400/55 |
| 3,960,256 | 6/1976 | Bickoff et al. | 400/124 |
| 4,010,834 | 3/1977 | Linder | 400/124 X |
| 4,024,940 | 5/1977 | Hendrischk et al. | 400/124 X |
| 4,086,997 | 5/1978 | Wu | 400/124 X |

FOREIGN PATENT DOCUMENTS

| | | | |
|---|---|---|---|
| 554389 | 2/1977 | Belgium | 74/37 |
| 2838627 | 3/1979 | Fed. Rep. of Germany | 400/55 |
| 288949 | 9/1931 | Italy | 74/37 |

*Primary Examiner*—Ernest T. Wright, Jr.
*Attorney, Agent, or Firm*—Weinstein & Sutton

[57] ABSTRACT

A bidirectional belt-drive for printers and the like comprising a carriage assembly movable across a paper web and supporting a print head mounting bracket. A belt has upper and lower runs extending through guide passageways in the carriage assembly. Independent jam cleat assemblies are normally biased by single spring means to a neutral position so as to be displaced from both runs of the belt.

Swingably mounted knurled supporting surfaces cooperate with the jam cleat assemblies to enhance gripping of the fabric belt. Each jam cleat assembly has a pair of cooperating arms whose free ends are arranged to engage one another and extend between the arms of the single torsion spring means.

The carriage assembly print head slidably receives the mounting bracket which is urged in the forward direction by bias means and may be adjustably positioned by adjustable cam means to enable the carriage assembly to maintain a fixed position relative to the platen and requiring only movement of the print head mounting bracket. The carriage assembly includes an open frame-shaped casting of a light-weight material significantly reducing inertia as well as the load imposed upon the driving system.

Movement of the carriage assembly, regardless of the direction of said movement, drives a ribbon cartridge drive shaft, through a pair of selectively operable clutch assemblies mounted to move with the carriage and rotated by wires encircling the clutch assemblies.

14 Claims, 6 Drawing Figures

BI-DIRECTIONAL BELT DRIVE, PRINT HEAD MOUNTING MEANS AND PRINTING PLANE ADJUSTMENT MEANS FOR SERIAL PRINTERS

BACKGROUND OF THE INVENTION

The present invention constitutes an improvement over the bidirectional belt drive assembly described in U.S. patent Application Ser. No. 692,484 filed June 3, 1976, filed in the name of R. Howard et al and assigned to the assignee of the present application and abandoned in favor of continuation application Ser. No. 28,318, filed Apr. 9, 1979. The apparatus disclosed therein is comprised of a closed loop belt entrained about a pair of pulleys and tensioned so as to provide upper and lower substantially linear belt runs. A carriage assembly is mounted for slidable movement along a pair of guide rods extending substantially parallel to said belt runs. A print head is mounted upon the carriage for effecting printing upon a paper web arranged to pass along a platen which is aligned substantially parallel to said guide rods.

In order to cause printing in a desired direction, a first, one of a pair of solenoid control means is energized to rotate a jam cleat into wedging engagement with one run of said belt, the jam cleat being urged against said belt to clamp said belt between the wedging member and the surface of a backing means. The angular orientation of the wedging member cooperates with the direction of movement of the belt to cause the wedging member to be wedged against the belt and thereby enhance the clamping action to effect abrupt acceleration of the carriage assembly.

Movement of the carriage assembly in the reverse direction is accomplished by de-energizing the aforementioned first solenoid control means to release its jam cleat assembly and energizing the remaining solenoid control means to cause its associated jam cleat assembly to become wedged against the opposite run of said belt. The belt is driven at a constant rate by a constant speed motor whose output shaft rotates the drive pulley in one direction at a constant angular velocity, the opposite pulley being an idler pulley driven to rotate by virtue of the belt entrained therearound.

With printers of this type it is extremely important to be able to accelerate from a standstill position up to the constant velocity desired for printing as rapidly as possible. This objective is basically achieved by the above-mentioned wedging action. However, it is extremely important to provide adequate positive engagement between the jam cleat assemblies and the belt in order to clamp the belt and it is thereby important to provide an engaging surface of sufficient surface area to prevent undue wearing of both the jam cleat assembly wedging portion and the belt, while at the same time retaining the highly desirable wedging configuration.

It is further highly desirable to provide a carriage assembly which, while having all of the above attributes, has a low mass in order to facilitate its rapid acceleration.

Also the carriage taught in the aforementioned pending application requires that the carriage be moved relative to the platen by means of a complex eccentric mounting for adjusting the position of the print wire tips relative to the platen thereby complicating the carriage assembly.

BRIEF DESCRIPTION OF THE INVENTION

The present invention is characterized by providing a bidirectional belt-drive assembly for use in printers and the like and which constitutes a significant improvement over that described in the above-mentioned application. Each of the jam cleat assemblies is provided with a locator arm extending toward the central portion of the carriage whereby free ends of said locator arms are arranged adjacent to one another and are adapted to cooperate with a torsion spring for normally simultaneously biasing both of said jam cleat assemblies to neutral positions where they are displaced from the associated runs of said drive-belt so as to provide highly simplified and yieldingly interconnected jam cleat structures.

The wedging action is obtained by wedging portions of said jam cleat assemblies which cooperate with swingably mounted backing pads which are preferably provided with knurled surfaces to immediately adjust for any misalignment as between the backing surfaces, the belt and the jam cleat assemblies in order to provide the excellent clamping action with a minimum of slippage. The energization of a solenoid causes its jam cleat assembly to positively urge the other jam cleat assembly away from engagement with the belt.

The carriage includes means for slidably mounting a print head mounting bracket for the print head and cam means provided to urge the print head mounting bracket into the proper position relative to the platen and against the force of a spring means which urges the print head mounting bracket against the cam means. This arrangement enables the carriage to be accurately located relative to the platen while greatly simplifying the carriage assembly and also provides a simplified arrangement for mounting and/or disassembling the print head from the carriage. The carriage is an open-frame casting of a light-weight material greatly simplifying assembly and disassembly of the carriage components, as well as significantly reducing both its mass and inertia.

The ribbon drive assembly comprises a pair of wrap-spring clutches activated only during carriage movement. The ribbon drive shaft rotates in only one direction regardless of the direction of movement of the carriage.

OBJECTS OF THE INVENTION AND BRIEF DESCRIPTION OF THE FIGURES

It is, therefore, one object of the present invention to provide an improved bidirectional belt-drive for printers and the like employing jam cleat assemblies cooperating with swingably mounted feet to provide excellent clamping action between the jam cleat assemblies and the belt even in the case of any misalignment therebetween.

Still another object of the present invention is to provide a novel bidirectional belt-drive for printers and the like in which jam cleat assemblies are provided with cooperating locator arms which cooperate with single torsion spring means for normally displacing both jam cleat assemblies from their associated belt runs when the control means for both jam cleat assemblies are de-energized and for permitting only one of said jam cleat assemblies to engage its associated belt run in any given instant and, thereby, avoid faulty operation.

Still another object of the present invention is to provide a carriage assembly which is lighter in weight and simpler in design as compared with conventional carriages of the type described.

Still another object of the present invention is to provide a carriage having a slidable resilient mounting for a print head which is of simplified design and which simplifies assembly and/or removal of the print head and adjustment of the print head upon the carriage.

Still another object of the invention is to provide a carriage of the type described and having a dual wrap-spring clutch assembly for driving a ribbon drive shaft in only one direction regardless of the direction of movement of the carriage.

The above, as well as other objects of the present invention, will become apparent when reading the accompanying description and drawing in which.

Figure 5B:
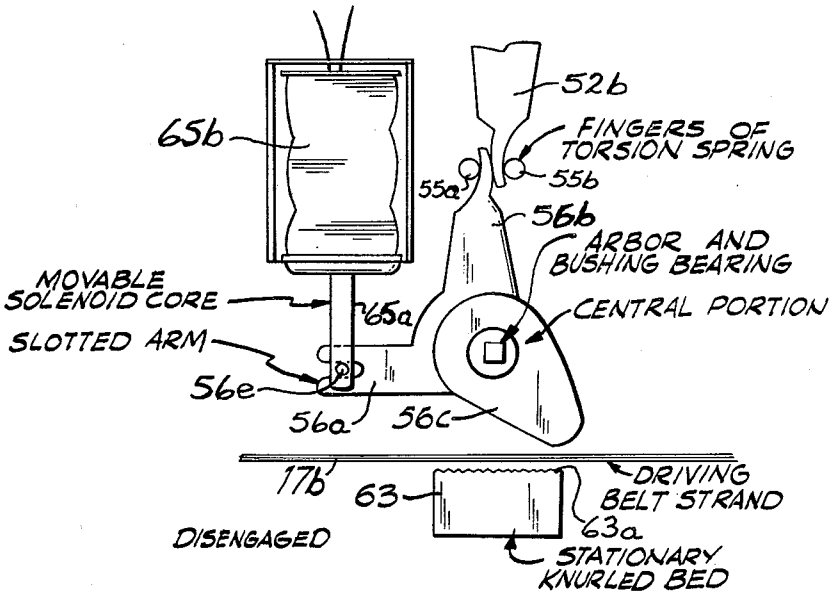
Figure 5A:
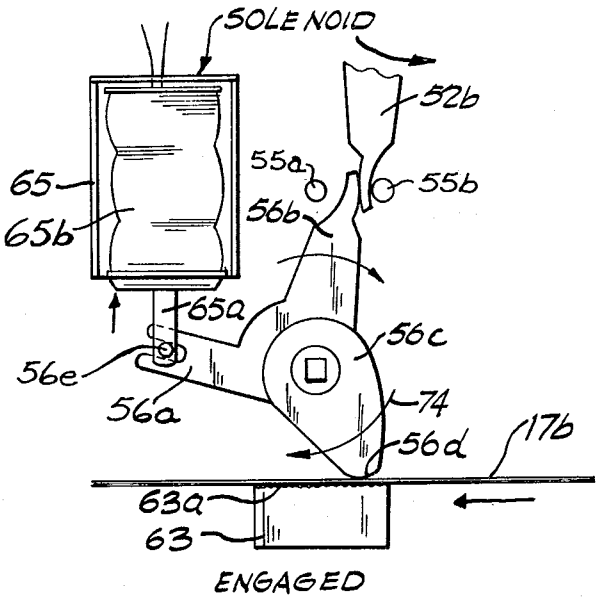

FIGS. 5*a* and 5*b* show detailed elevational views of one of the drive assemblies which views are useful in explaining the operation of the present invention.

DETAILED DESCRIPTION OF THE INVENTION

Figure 1:
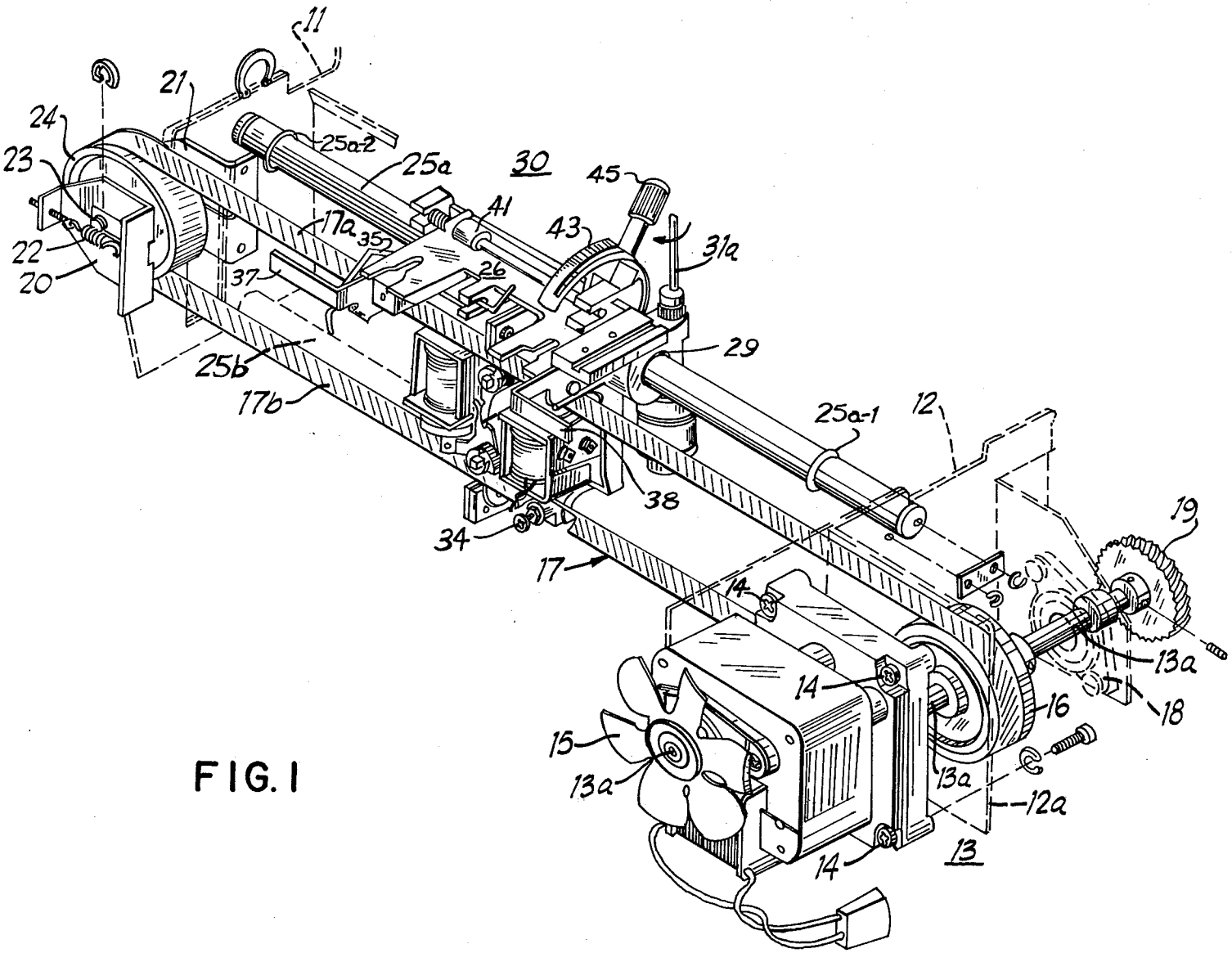
FIG. 1 shows a perspective view of a bidirectional carriage drive assembly designed in accordance with principles of the present invention.

The present invention, as shown for example in FIG. 1, comprises a pair of mounting brackets (i.e. frames) 11 and 12 for supporting the carriage and carriage-drive assembly. A drive-motor assembly 13 is secured to bracket portion 12*a* of bracket 12 by fasteners 14. The motor output shaft 13*a* is utilized to drive fan 15 employed for cooling the printer electronics as well as rotating pulley 16 about which carriage-drive belt 17 is entrained. Shaft 13*a* is supported by a bearing assembly 18 shown in dotted fashion. A helical gear 19 is mounted at the remote end of shaft 13*a* for operating other devices within the printer such as the paper-feed means (not shown for purposes of simplicity).

Bracket 11 has secured thereto a pair of carriage belt adjusting brackets 20 and 21 each having spring means, such as spring 22, for exerting a force upon the shaft 23 of carriage drive idler pulley 24 to maintain belt 17 under suitable tension. Only one spring 22 has been shown for purposes of simplicity.

A pair of rods 25*a* and 25*b*, rod 25*b* being shown in dotted fashion, have their ends secured to brackets 11 and 12 and serve as a means for supporting and guiding the carriage assembly 30 to be more fully described. Belt 17 is preferably formed of a sturdy fabric comprised of a fiber material such as woven poly fibers impregnated with polyurethane. The surfaces of pulleys 16 and 24 are preferably formed of a material making good frictional engagement with belt 17. The O-rings 25*a*-1, 25*a*-2 and similar O-rings (not shown) on rods 25*a* and 25*b*, respectively serve to cushion the shock of impact as the carriage reaches the left and right-hand end points of its travel.

Figure 2:
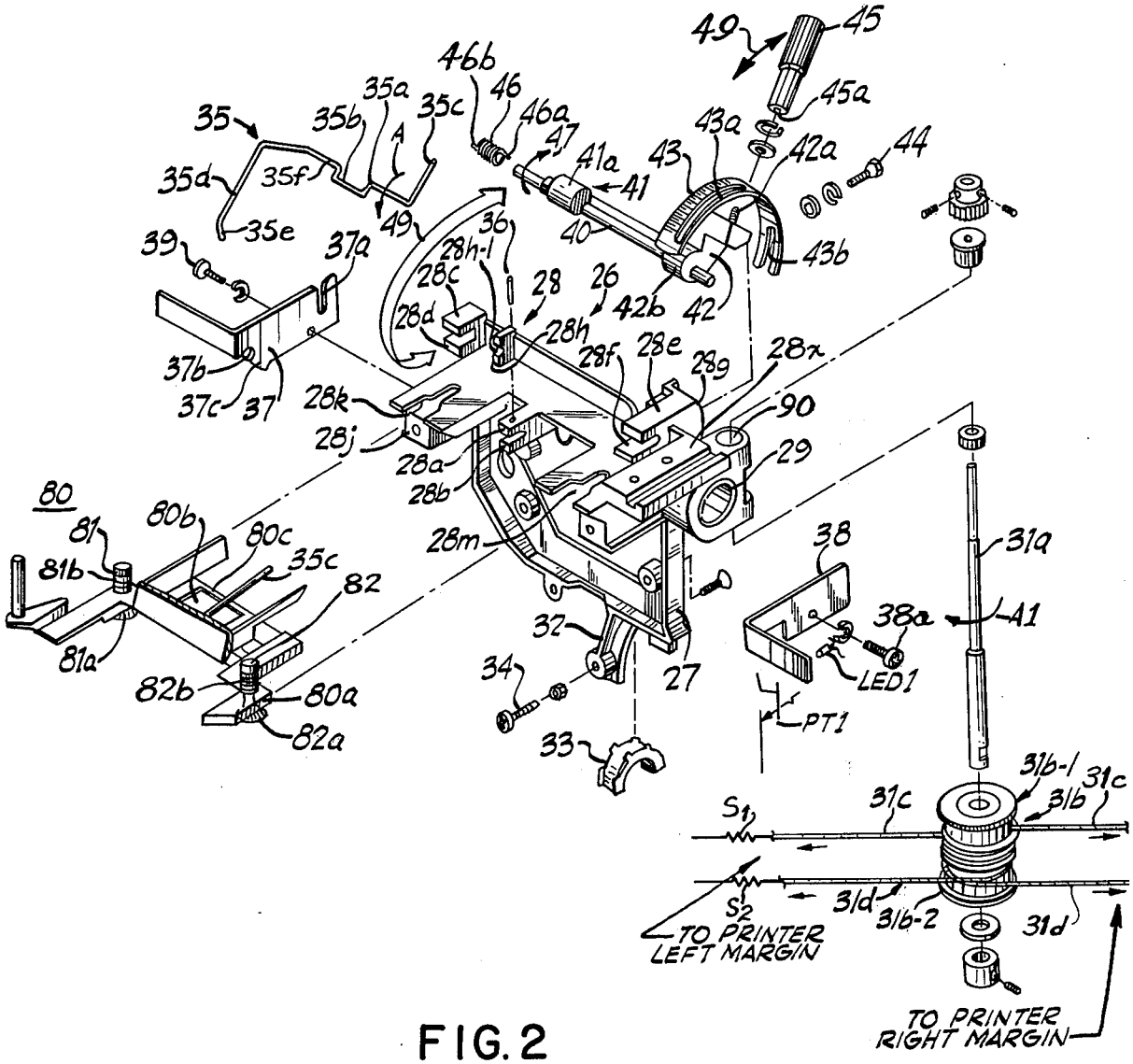
FIG. 2 shows an exploded perspective view of the carriage drive assembly of FIG. 1.
Figure 3:
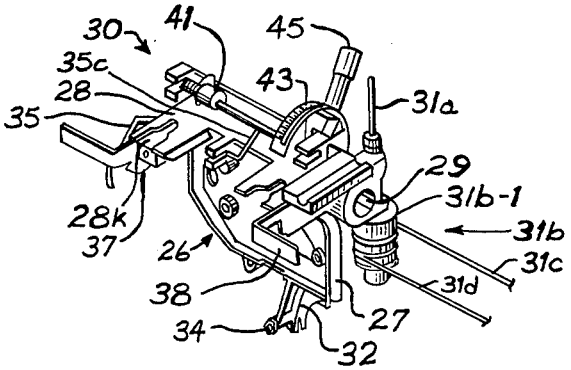
FIG. 3 shows a perspective view of the carriage drive assembly mounted upon the carriage frame.

The carriage assembly 30 which is shown best in FIGS. 1, 2 and 3 is comprised of a one-piece open frame casting 26 having a substantially vertically aligned portion 27 for receiving and supporting the carriage drive jam cleat assemblies, and a horizontally aligned surface defining a platform 28 for receiving and supporting the print head mounting bracket 80 for supporting a print head (not shown for purposes of simplicity). The casting 26 is light in weight and is preferably formed of aluminum.

The carriage assembly casting 26 is provided with a straight, horizontally aligned bushing 29 just below the mounting surface or platform 28 for the print head mounting bracket 80, which bushing 29 is adapted to slidably receive guide rod 25*a* as shown best in FIG. 1.

Arranged at right angles to bushing 29 is a vertically aligned bushing 90 which rotatably supports a drive shaft 31*a* which is adapted for driving a ribbon (not shown) provided within a ribbon cartridge assembly (not shown for purposes of simplicity) which is preferably adapted to be mounted upon surface portion 28*x* of the carriage assembly 30. Shaft 31*a* is rotated in only one direction by clutch assembly 31*b*. Wires 31*c and 31d* are wrapped about upper and lower clutch assemblies 31*b*-1 and 31*b*-2. The left-hand ends of wires 31*c* and 31*d* are secured to a portion of the printer frame 11 and the right-hand ends of the wires 31*c*, 31*d* are secured to a portion of the printer frame 12. For example, wires 31*c* and 31*d* may be secured between brackets 11 and 12. Springs $S_1$, $S_2$ are preferably connected between the left-hand ends of wires 31*c* and 31*d* and bracket 11 to maintain wires 31*c* and 31*d* under the proper tension. The clutch assemblies 31*b*-1 and 31*b*-2 may be of the wrap-spring type typically referred to as mechanically activated wrap-spring clutches which are disengaged when rotated in one direction and engaged when rotated in the reverse direction. Note for example, the PSI Series Wrap-Spring clutch manufactured by the PSI Division of Warner Electric Brake & Clutch Company of Pitman, N.J.

Each clutch assembly 31*b*-1 and 31*b*-2 has its inner surface secured to shaft 31*a*. When the carriage assembly 30 is stationary, both clutch assemblies 31*b*-1 and 31*b*-2 are disengaged. When the carriage assembly 30 moves from left-to-right, the wires 31*c* and 31*d*, which are wrapped in opposite senses about the outer surfaces of their associated clutch assemblies 31*b*-1, 31*b*-2, rotate the outer bodies of the clutch assemblies 31*b*-1, 31*b*-2 in opposite directions. The clutch assembly 31*b*-1 engages, causing rotation of shaft 31*a* in the direction shown by arrow A1. Since clutch assembly 31*b*-2 is rotated in the opposite direction, this clutch assembly 31*b*-2 slips (i.e., is disengaged) so as not to have any effect on the rotation of the shaft 31*a*. When the carriage assembly 30 moves from right-to-left, the rotations imparted to the clutch assemblies 31*b*-1 and 31*b*-2 are reversed causing clutch assembly 31*b*-1 to slip and causing clutch assembly 31*b*-2 to engage and to rotate shaft 31*a* in the same direction (A1) as when the carriage assembly 30 moves from left-to-right.

An inverted U-shaped portion 32 of casting 26 receives a semi-circular shaped plastic bearing member 33 to provide a low friction sliding bearing which slidably rests upon guide rod 25*b*. Fastening means 34 serves to secure the plastic bearing member 33 in position in order to adjust the clearance between bearing member 33 and rod 25*a*.

The carriage assembly 30 further includes a wire spring 35 having a first intermediate portion 35*a* mounted between a pair of bifurcated arms 28*a* and 28*b* arranged below the surface of the platform 28 formed in the carriage casting 26. A fastening pin 36 extends through arm 28*a* and threadedly engages the arm 28*b* to retain the intermediate portion 35*a* of the spring 35 in position. The spring 35, which is further made up of portions 35*b*-35*f*, has portion 35*f* extending through an opening (not shown for purposes of simplicity) in portion 28*j* of casting 26 and has portion 35*e* which cooperates with slot 37*b* in bracket 37, and portion 35*c* which cooperates with a portion of the print head mounting bracket 80 to provide a resilient mounting for the print head mounting bracket 80 which enables the print head mounting bracket 80 (and hence the print head) to be simply and rapidly removed and/or secured to the carriage casting 26.

A pair of L-shaped brackets 37 and 38 each cooperate with an LED (such as LED 1) and a photo transistor (such as PT1) to generate an end-of-line signal when the carriage assembly 30 arrives at the left and right-hand margins of the paper document (not shown) so that the free end of the bracket, for example bracket 38, moves between LED 1 and photo transistor PT1 to block the light developed by the light emitting element LED 1 from reaching photo transistor PT1. A signal is thus generated indicating the right (or left) hand end of the line has been reached.

One arm of bracket 37 is provided with a slot 37*a* for receiving a portion 35*f* of wire spring 35 between the left-hand side of casting 26. Bracket 37 is secured to the casting 26 by fastening means 39.

Slot 37*b* provided in bracket 37 receives the curved end 35*e* of spring 35 to lock the print head mounting bracket 80 in position. The print head (not shown) is secured to the mounting bracket 80, a portion of which is shown in FIG. 2. The mounting bracket 80 has a pair of spring loaded pins 81, 82 which are slidably inserted into slots 28*k*, 28*m* in platform 28 so that the feet portions 81*a*, 82*a* of pins 81, 82 lie below the slots 28*k* and 28*m* while the base 80*a* of mounting bracket 80 rests upon the top surface of platform 28. The lower surface of platform 28 is tapered to facilitate slidable mounting of the bracket 80 and the feet portions 81*a*, 82*a* upon the carriage assembly 30. Springs 81*b* and 82*b* normally urge the feet portions 81*a*, 82*a* upwardly toward base 80*a*.

Spring portion 35*c* of spring 35 extends through slot 80*b* in mounting bracket 80 to resiliently urge the bracket 80 towards the cam faces of eccentric cams 41 and 42*b* which abut against the forward edge 80*c* of mounting bracket 80. The cams 41 and 42*b* may be adjusted by loosening arm 45, swinging arm 45 to adjust the positioning of the print head mounting bracket 80 on the carriage assembly 30 and then tightening arm 45 lock the arm 45 against arcuate segment 43 and thereby retain the desired adjustment. The threaded stud 42*a* on projection 42 extends through slot 43*a* in graduated arcuate segment 43.

By moving the free end 35*e* of spring arm 35*d* out of slot 37*b* and to the left of short projection 37*c*, to allow spring arm 35*c* to rotate in the direction of arrow A, the spring force exerted on the print head mounting bracket 80 by spring 35 is released, allowing the bracket 80 (and print head secured thereto) to be slidably moved rearwardly and then removed from the carriage casting 26, highly simplifying the mounting, dismounting and adjustment of the print head mounting bracket 80.

Fastening means 38*a* secures bracket 38 to the right-hand end of casting 26. Two pairs of bifurcated arms 28*c*-28*d* and 28*e*-28*f* serve as the means for receiving and rotatably mounting cam shaft 40 having a cam 41 with a substantially barrel-shaped cam face 41*a* spaced inwardly from its left-hand end. The semi-circular shaped graduated segment 43 has an elongated slot 43*a* and has its forward end secured to the carriage assembly 30 by fastening means 44 cooperating with slot 43*b* and threadedly engaging a tapped aperture (not shown) provided in the curved surface portion 28*g* of casting 26. Projection 42 is provided with an outwardly-extending threaded member 42*a* which threadedly engages a tapped opening 45*a* in threaded arm 45.

A projection 28*h* having a semi-circular shaped groove 28*h*-1 serves to slidably engage cam shaft 40 and to retain the cam 41 between projection 28*h* and bifurcated arms 28*c*-28*d*.

The left end of cam shaft 40 is inserted into helical spring 46, which spring 46 is wedged between the projection forming bifurcated arms 28*c*-28*d* and the projection 28*h* having the semi-circular slot 28*h*-1. The ends 46*a* and 46*b* of spring 46 may be inserted into openings (not shown for purposes of simplicity) provided in the aforementioned projection 28*h* and the projection having arms 28*c*, 28*d*. Spring 46 holds the cam shaft 40 in its proper position and assures its smooth rotatable movement. The forward bias force exerted by spring 35 upon the print head mounting bracket 80 also serves to maintain the cam shaft 40 properly seated with the grooves between bifurcated arms 28*c*-28*d* and 28*e*-28*f*.

The cam shaft 40 may be rotated by loosening threaded knob or arm 45 and urging it in either the clockwise or counterclockwise direction as shown by arrow 49, thus urging the cam faces 41*a*, 42*b* against the cooperating surface or edge 80*c* of the print head mounting bracket 80 to move the printing end of a print head which may be mounted thereon either closer to or further away from the paper-document supporting platen (not shown) for providing an accurate alignment of the print head.

Figure 4:
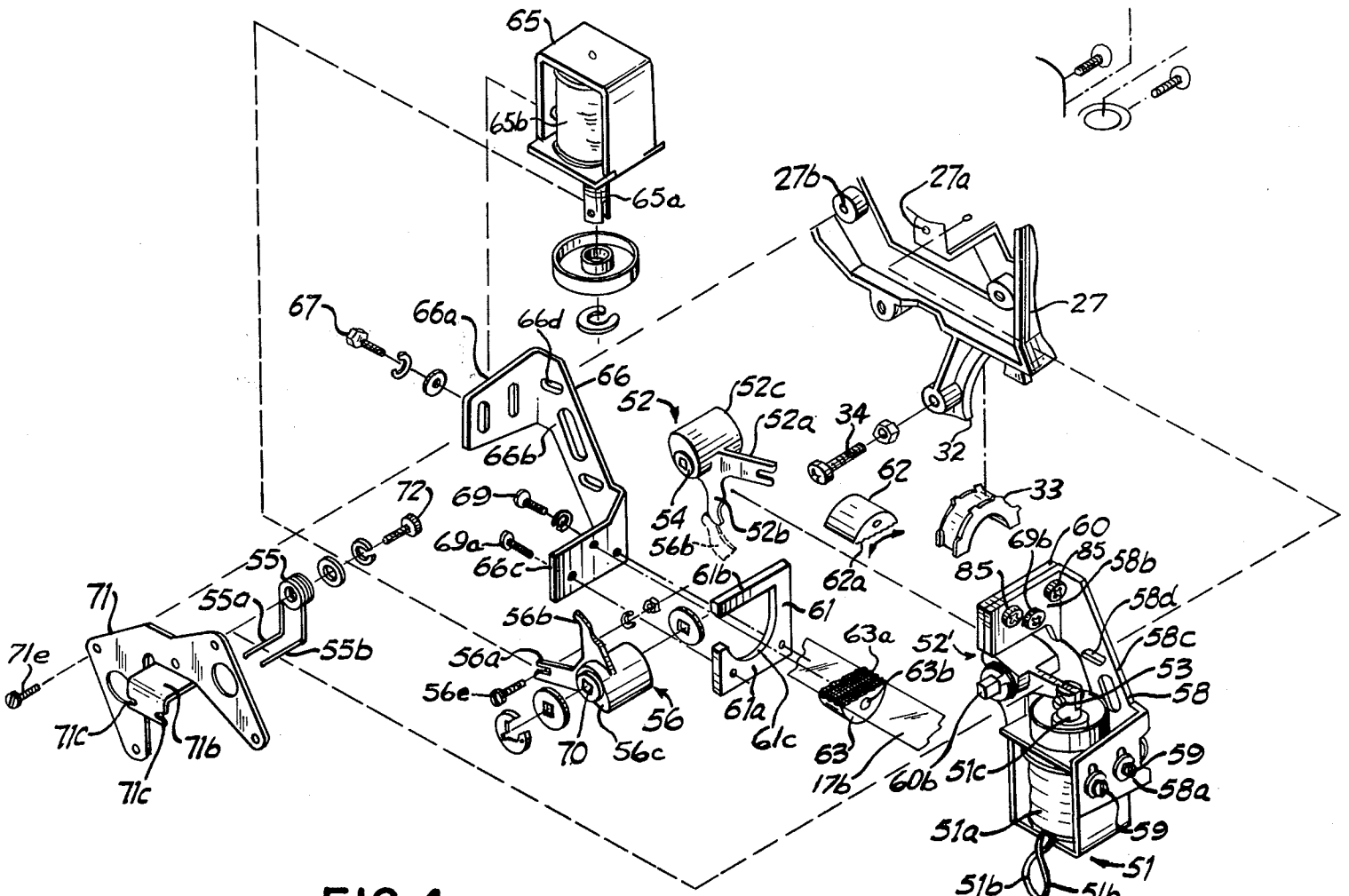
FIG. 4 shows an exploded perspective view of the drive assembly mounted upon the carriage.

The carriage assembly 30 is driven in either the forward or the reverse direction by means of the carriage drive belt 17 in cooperation with the jam cleat assemblies as shown in detail in FIG. 4. A pair of jam cleat assemblies are provided. The right-hand jam cleat assembly comprises a solenoid assembly 51 having a coil 51*a* with leads 51*b* for connection to a suitable electrical driving means (not shown). The solenoid armature 51*c* extends vertically upward and is mechanically linked to the drive arm 52*a* of upper jam cleat 52. Upper jam cleat 52, as shown best in FIG. 4, has a drive arm 52*a* whose free end is pivotally coupled with the bifurcated end of armature 51*c* by fastener 53. The jam cleat 52 which is shown in FIG. 4 assembled with solenoid assembly 51 at 52' and separated from solenoid assembly 51 at 52, is provided with a hollow bushing bearing 54 for receiving a supporting projection 60*b* of square cross-section which is an integral part of a bearing plate 60 which is similar to bearing plate 61 shown in FIG. 4 and which is shown as being assembled to portion 58*b* of bracket 58. The upper jam cleat 52 is freely rotatable about bushing bearing 54.

The locator arm 52*b* of the upper jam cleat 52 extends substantially vertically downward and cooperates with a torsion spring 55 as does the upwardly extending locator arm 56*b* of the lower jam cleat 56 in a manner to be more fully described.

The solenoid assembly 51 is mounted to the carriage casting 26 by means of a bracket 58. Arm 58*a* of bracket 58 secures the bracket 58 to the solenoid assembly 51 by fasteners 59.

The upper bearing plate 60 is secured to the upper arm 58*b* of bracket 58 by fastening means 85. Upper bearing plate 60 is identical to lower bearing plate 61 except that it is inverted whereby the lower end 61*a* of bearing plate 61 can be seen to be arranged so as to be positioned below the lower arm 61*b* of bearing plate 61.

A semi-circular shaped stationary knurled bed 62 is mounted within the semi-circular shaped portion (not shown) of upper bearing plate 60, which, although not shown, is identical to semi-circular shaped portion 61*c* of bearing plate 61, and is secured to upper arm 58*b* of bracket 58 by suitable fastening means 85. The knurled bed 62 is adapted to rotate either clockwise or counterclockwise about its threaded fastening means 69*b* so as to adjust for any unevenness in the belt 17 and/or wedging as it moves beneath the knurled surface 62*a*.

The intermediate portion 58*c* of bracket 58 is provided with an opening 58*d* for receiving fastening means (not shown for purposes of simplicity) to secure the bracket 58 to the opening 27*a* in casting portion 27.

The lower jam cleat 56 of the carriage drive can be seen to be comprised of a similar solenoid assembly 65 having solenoid 65*b* and armature 65*a* and cooperating with a bracket 66 substantially identical to bracket 58 and having its arm 66*a* secured to the left-hand side of the solenoid assembly 65 by fastening means 67. The intermediate portion 66*b* of bracket 66 is secured to the casting 26 by suitable fastening means 71*e* which cooperate with opening 66*d* and opening 27*b* in casting portion 27. The lower arm 66*c* of bracket 66 secures the lower bearing plate 61 thereto by fastening means 69*a*. The lower knurled bed 63 is provided with a threaded opening 63*b* cooperating with threaded fastening means 69 to secure the knurled bed 63 to bracket arm 66*c* so that it is arranged within the semi-circular portion 61*c* of bearing member 61. Arm 56*a* of jam cleat 56 is joined to bifurcated armature 65*a* of solenoid assembly 65 by fastener 56*e*.

The square shaped arm 61*b* of bearing plate 61 receives the hollow bushing bearing 70 within the lower jam cleat 56 to provide a swingable pivot for the lower jam cleat 56. It should be understood that the bushing 54 of the upper jam cleat 52 cooperates with the upper bearing plate 60 in a similar fashion.

The torsion spring 55 is secured to a mounting plate 71 by fastening means 72. The free ends 55*a*, 55*b* of the torsion spring 55 embrace the ends of the upper and lower locator arms 52*b* and 56*b* as can best be seen in FIGS. 5*a* and 5*b*. The free ends 55*a*, 55*b* extend beyond the locator arms 52*b* and 56*b* and are embraced within the slots 71*c*, 71*c* provided in the bent portion 71*b* of mounting plate 71.

The carriage drive operates in the following manner:

Presuming that both solenoid assemblies 51 and 65 are de-energized, the jam cleats 52 and 56 are under the control of torsion spring 55 in a manner such that the ends 55*a*, 55*b* of the torsion spring 55 urge the two locator arms 52*b*, 56*b* toward one another and maintain them in a neutral position substantially centrally located between the two solenoid assemblies 51 and 65. In this position it can be seen that the lower jam cleat rocker arm 56*c* is displaced from the lower run 17*b* of belt 17 (FIG. 5*b*) so that the belt 17 is free to move between the lower stationary knurled bed 63 and the lower jam cleat rocker arm 56*c*. It should be understood that the upper jam cleat rocker arm 52*c* is also displaced from its cooperating stationary knurled bed 62 to permit free movement of the upper run 17*a* (FIG. 1) of fabric belt 17 between members 52*c* and 62. Thus, the carriage assembly 30 experiences no movement whatsoever when both solenoid assemblies 51, 65 are de-energized.

Let it now be assumed that solenoid assembly 65 is energized. The energization of the solenoid winding 65*b* urges its armature 65*a* to be pulled upwardly causing the lower jam cleat 56 to rotate clockwise in the manner shown by arrow 74. This clockwise movement causes jam cleat wedge portion or arm 56*c* to be urged into wedging engagement with the lower run 17*b* of the fabric belt 17. The belt 17 is gripped between the flattened surface 56*d* of the jam cleat rocker arm 56*c* and the knurled surface 63*a* of the stationary knurled bed 63. In case of any misalignment between the two members 56*c* and 63, the knurled bed 63 is free to swing about its pivotal mounting (fastener 69*a*) to assure parallel alignment as between flattened surface 56*d* and the knurled surface 63*a* of bed 63. The fabric belt 17 is very firmly gripped between surfaces 56*d* and 63*a* immediately imparting acceleration to the carriage assembly 30 in a direction to move the carriage assembly 30 from right to left.

Simultaneously with the above operation, the upper end of locator arm 56*b* is urged against the lower end of locator arm 52*b* with a force sufficient to overcome the biasing force of torsion spring 55. As a result, the upper jam cleat 52 is rotated in the counterclockwise direction further displacing the upper jam cleat rocker arm 52*c* from its cooperating knurled bed 62.

By energizing solenoid assembly 51 and de-energizing solenoid assembly 65, the reverse operation is performed thus providing movement of the carriage assembly 30 in the forward or left to right direction.

The torsion spring arms 55*a*, 55*b* urged apart when either of the solenoid assemblies 51, 65 is energized and moved back toward one another upon de-energization to return the locator arms 52*b*, 56*b* to the position shown in FIG. 5*b*, thus providing a rapid and yet resilient restoring force.

The arrangement of the present invention provides a simple and yet lightweight carriage assembly enabling rapid acceleration of the carriage assembly to print speed in either direction and the carriage assembly may be used to great advantage in both unidirectional or bidirectional printers.

It should be understood that while this invention has been described with respect to a particular embodiment thereof numerous others will become obvious to those of ordinary skill in the art in light thereof.

What is claimed is:

1. Carriage driving means for printers and the like comprising:

a belt having upper and lower belt runs;

means for driving said belt to move the upper and lower belt runs in opposing directions;

a carriage assembly;

means for slidably guiding said carriage assembly along a path arranged substantially parallel to at least one run of said belt;

a pair of jam cleat assemblies pivotally mounted upon said carriage assembly adjacent to and extending generally toward said upper and lower belt runs, respectively, a solenoid assembly operatively associated with each jam cleat assembly;

each of said jam cleat assemblies having a wedge arm portion extending diagonally away from its pivotal mounting and toward its associated belt run;

each jam cleat assembly comprising a first arm extending outwardly from said pivotal mounting and being operable by its associated solenoid assembly for pivoting the jam cleat assembly;

each jam cleat assembly comprising a second arm extending outwardly from said pivotal mounting toward and having a free end for engaging the free end of the second arm of the other jam cleat assembly; and a small, single spring member embracing the free ends of said second arms and urging said second arms together toward a neutral position whereby both wedge arm portions are displaced from engagement with said belt runs when the solenoid assemblies are deenergized.

2. The carriage driving means of claim 1 further comprising:

an upper and a lower swingably mounted bed member cooperating with each of said jam cleat assemblies and positioned respectively above the upper belt run and below the lower belt run whereby the upper belt run is sandwiched between the wedge arm portion of one of said jam cleat assemblies and said upper bed member and the lower belt run is sandwiched between the wedge arm portion of the remaining one of said jam cleat assemblies and said lower bed member when the operatively associated solenoid assembly is energized;

the wedge arm portions of said jam cleat assemblies being mounted in a manner such as to become selectively wedged against their associated belt run whereby the direction of movement of the wedge arm portion and the direction of movement of said belt cooperate to provide wedging engagement for driving the carriage assembly in a direction determined by that solenoid assembly which is energized.

3. The apparatus of claim 2 wherein both of said bed members are pivotally mounted along a pivotal axis parallel to the direction of movement of said belt runs to compensate for any misalignment between the surface of each wedge arm portion and its associated bed member and the portion of the belt extending therebetween.

4. The apparatus of claim 1 wherein said spring member is a torsion spring having a helical central position and outwardly extending arms embracing the free ends of the second arms of the pair of jam cleat assemblies for normally urging said second arms together.

5. The apparatus of claim 2 wherein the belt engaging surfaces of said bed members are knurled.

6. The apparatus of claim 2 wherein bearing means are provided for each bed member; each bed member having an arcuate supporting surface, each bearing means having an arcuate bearing surface for slidably engaging the arcuate surface of its associated bed member;

each bearing means having an integral arm extending a spaced distance from said bearing surface for receiving and rotatably supporting the associated jam cleat assembly.

7. The apparatus of claim 1 wherein each of said second arms is arranged to engage the other second arm to swing the jam cleat assembly associated with the other second arm so that its wedge arm portion is disengaged from the associated belt run when its associated solenoid assembly is energized.

8. A carriage assembly for use in a printer, said carriage assembly comprising:

a platform;

means for guiding the platform along a linear path and for enabling the platform to experience reciprocating movement along said linear path;

a print heat assembly mounting bracket having mounting means extending towards said platform;

said platform including means for slidably receiving and guiding said print head assembly mounting bracket;

resilient bias means on said platform for urging the print head assembly mounting bracket in a first direction; and swingable cam means mounted on said platform and slidably engaging said print head assembly mounting bracket for adjusting the position of the mounting bracket on the platform, whereby said resilient bias means urges the print head assembly mounting bracket into engagement with said cam means to maintain the position of the print head assembly mounting bracket on the platform.

9. The carriage assembly of claim 8 wherein the cam means is comprised of an eccentric cam member swingably mounted upon a pivot;

means for rotating the cam means; and means for locking the rotating means to retain the position of said cam means and thereby retain the desired spacing between the print head assembly mounting bracket and said platform.

10. The carriage assembly of claim 9 wherein said locking means further comprises an arcuate member secured to said platform, said rotating means including means for clamping said rotating means to said arcuate member when the desired spacing between the print head assembly mounting bracket and the platform is attained.

11. The apparatus of claim 8 wherein said print head assembly mounting means comprises a plurality of spring biased reciprocally mounted projections having enlarged free ends;

said means for receiving said print head assembly mounting bracket comprising slots for slidably receiving said respective ones of said projections whereby the mounting bracket and the enlarged free ends of said projections firmly embrace said platform as a result of the biasing force of the spring biased projections.

12. A carriage assembly for use in a printer, said carriage assembly comprising:

a platform; means for guiding the platform along a linear path and for enabling the platform to experience reciprocating movement along said path;

a mounting bracket having mounting means extending towards said platform;

said platform including means for slidably receiving and guiding said mounting bracket; resilient bias means swingably mounted upon said platform and movable between a first position for retaining said mounting bracket upon said platform and a second position displaced from said mounting bracket to facilitate slidable removal of the mounting bracket from the platform.

13. The carriage assembly of claim 12 further comprising means for locking said resilient bias means whereby said resilient bias means is provided with an operating arm and a print head assembly engaging portion, said print head assembly engaging portion being urged against the print head assembly mounting bracket when said operating arm engages said locking means.

14. A printer comprising a carriage assembly:

means for reciprocally guiding said carriage assembly along a linear path;

belt means having upper and lower belt runs and means for moving said belt means;

first and second jam cleat assemblies pivotally mounted upon said carriage assembly adjacent to and toward the lower and upper sides respectively of said upper and lower belt runs;

each of said jam cleat assemblies having a short first arm serving as a wedge portion and second and third arms, each of said wedge portions extending diagonally away from their pivotal mountings and toward the associated belt run;

first and second solenoid assemblies;

the second arm of each jam cleat assembly being operable by an associated one of said solenoid assemblies;

the third arms of each jam cleat assembly extending toward and engaging one another;

spring means embracing said third arms of said jam cleat assemblies for urging said third arms into engagement;

means for mounting an intermediate portion of said spring means in order to normally maintain said wedge portions of said jam cleat assemblies displaced from their associated belt runs;

swingably mounted bed members each cooperating with one of said jam cleat assemblies and positioned respectively above the upper belt run and below the lower belt run whereby the upper belt run is sandwiched between one of the jam cleat assembly wedge portions and one of the bed members when the associated upper solenoid assembly is energized and whereby the lower belt run is sandwiched between the remaining jam cleat assembly wedge portion and the remaining bed member when the associated lower solenoid assembly is energized;

a print head mounting bracket having mounting means for mounting the print head mounting bracket on the carriage assembly;

said carriage assembly including a platform having means for slidably receiving said mounting bracket;

rotatable cam means positioned to engage one end of said mounting bracket;

resilient means swingably mounted on said platform for resiliently urging said mounting bracket in a first direction towards said cam means;

means for adjusting said cam means to alter the position of the mounting bracket on said platform and including means for locking the cam means in position after the desired adjustment is obtained.

* * * * *